US005459929A

United States Patent [19]

Lindén et al.

[11] Patent Number: 5,459,929

[45] Date of Patent: Oct. 24, 1995

[54] TOOL HAVING INTEGRAL HINGE MEMBER

[75] Inventors: Erkki O. Lindén; Veikko Mäkipelto, both of Billnäs, Finland

[73] Assignee: Fiskars Oy Ab, Helsinki, Finland

[21] Appl. No.: 247,514

[22] Filed: May 23, 1994

Related U.S. Application Data

[63] Continuation of Ser. No. 40,339, Mar. 30, 1993, abandoned.

[51] Int. Cl.[6] ..... B26B 13/02; B26B 13/18

[52] U.S. Cl. ..... 30/234; 30/254; 30/266; 30/271; 30/341

[58] Field of Search ..... 30/254, 112, 113.2, 30/363, 191, 192, 193, 211, 250, 252, 261, 341, 233, 251, 266, 271; 294/28, 33, 99.2, 118, 119; 606/206, 208, 210; 81/416

[56] References Cited

U.S. PATENT DOCUMENTS

| | | | |
|---|---|---|---|
| 301,043 | 6/1884 | Brooks | 30/266 X |
| 1,273,839 | 7/1918 | Farrer et al. | 30/254 |
| 2,059,074 | 10/1936 | Whyte | 30/271 |
| 2,626,460 | 1/1953 | Wahl | 30/266 |
| 2,965,967 | 12/1960 | Wahl | 30/254 X |
| 3,006,072 | 10/1961 | Nicoletta | 30/266 |
| 3,282,137 | 11/1966 | Lovelace | 294/99.2 X |
| 3,636,954 | 1/1972 | Weston | 30/252 X |
| 3,735,763 | 5/1973 | Shannon et al. | 39/266 X |
| 3,817,078 | 6/1974 | Reed et al. | 294/99.2 X |
| 3,846,910 | 11/1974 | Davis | 30/271 |
| 3,906,957 | 9/1975 | Weston | 606/210 X |
| 3,972,333 | 8/1976 | Leveen | 606/210 X |
| 4,212,305 | 7/1980 | Laham | 606/210 |
| 4,526,172 | 7/1985 | Stephenson | 606/208 |
| 4,715,122 | 12/1987 | Lindén | 30/266 X |
| 4,715,639 | 12/1987 | Nicoletta et al. | 294/33 X |
| 4,901,440 | 2/1990 | Go et al. | 30/254 |
| 5,116,347 | 5/1992 | Butler | 606/210 X |

*Primary Examiner*—Rinaldi I. Rada
*Assistant Examiner*—Clark F. Dexter
*Attorney, Agent, or Firm*—Foley & Lardner

[57] ABSTRACT

The present invention relates to hinged tools such as scissors, shears, pruners, or the like, having a force applying end with formed handles and an opposed working end consisting of a pair of blades disposed across a hinged joint through which a force may be transmitted. In these tools the handles, which are formed integrally with the hinge, are provided with ridge support in the form of heel elements to establish suitable contact between the blades.

13 Claims, 3 Drawing Sheets

TOOL HAVING INTEGRAL HINGE MEMBER

This is a continuation application of application Ser. No. 08/040,339 of Lindén et al. filed Mar. 30, 1993 which is hereby abandoned.

FIELD OF THE INVENTION

The present invention relates, generally, to hinged tools such as scissors, shears, pruners, and the like. More particularly, this invention is concerned with tools having a force applying end with formed handles, and an opposed working end disposed across a hinged joint through which a working force may be transmitted. In these tools, the hinge joint is an integral part of the handles, preferably constructed as a living hinge. Although it will become apparent from the following description that certain features of the present invention may be utilized in hinged tools of various construction for application to specific uses, for ease of understanding and convenience, the following description will from time to time specifically refer to a pair of scissors as the most preferred implementation of the present invention.

BACKGROUND OF THE INVENTION

Implements having elongated members disposed for cooperative engagement about a joint are widely used by those desiring to transmit a force through the joint to a working piece engaged by the working surfaces of the implement. In particular, tools such as scissors generally comprise two elongated members disposed for cooperative engagement about a pivotable joint. To facilitate operation of the implement by the user, handles conforming to the fingers or hands of the user are preferably molded onto the force applying end (also called tang) of each elongated member, or in the case of anvil-type implements, one of the elongated members is entirely typically made of molded material.

As is well known, the joint in most of these implements commonly comprises a rivet or screw to maintain the members in suitable cooperative position, and washers when desired. Assembling such pivoted tools typically requires production personnel to bring apertures formed in the separately manufactured elongated members into registration to install the rivet or screw (and washers as necessary) to maintain those members in assembled relationship. In addition, to adjust the friction between the members to the desired amount, post-manufacturing finishing and adjusting operations are almost always required.

It has been found, however, that pivoted implements having screws or rivets tend to lose their original factory adjustment due to mechanical wear in the joint during normal operation. This deficiency has already been recognized and addressed by those skilled in the art and more particularly by those skilled in the scissors art. For example, U.S. Pat. No. 2,626,460 to Wahl discloses a pair of scissors in which the hinge is designed to enhance the durability of the frictional adjustment between the pivot members. Another approach to address mechanical wear has been disclosed in U.S. Pat. No. 3,735,763 to Shannon et al. In Shannon, one handle member is secured by a retaining clip to a hub formed integrally with the other handle. The clip, having an internal diameter smaller that the hub, causes frictional engagement between the hub and clip ensuring that the handles are maintained in assembled relationship.

From the foregoing, it can be readily recognized that prior art tools having elongated members maintained in cooperative position, such as scissors or the like, typically include a pivot member comprising several components which are susceptible to wear. In addition, the members to be joined are also typically provided with suitable apertures to permit their assembly. Necessarily, the manufacturing and assembling of such prior art tools usually includes several operations which, as a result, increase the cost of these items. These ultimately are all drawbacks, either for the manufacturer or the user.

Thus, it is desirable to provide tools such as scissors which are constructed to alleviate problems associated with prior art devices, i.e., in which the pivot member is modified or replaced, thereby eliminating problems associated with the mechanical wear in the pivot. The present invention responds to those needs while at the same time providing a new structure requiring fewer manufacturing and assembling operations.

SUMMARY OF THE INVENTION

The present invention facilitates the manufacturing of scissors or the like by eliminating certain assembling and post-manufacturing finishing operations typically required with similar prior art devices. The present invention also increases the durability of certain items such as scissors while maintaining functional quality. Tools produced according to the present invention are characterized in that the joint, about which a pair of elongated members cooperatively engages, comprises a hinge integrally formed with the handles molded onto the elongated members. Accordingly, the present invention, by utilizing an integrally formed articulation permitting motions only in one plane (i.e., a hinge) eliminates components such as screws, rivets, washers, etc., typically required to form the pivot member. This integrally formed hinge eliminates various sources of mechanical wear in the pivot while also simplifying manufacturing and reducing assembling operations.

According to another embodiment of the present invention, in a pair of scissors having a pair of blades provided with molded handles and a joint, the joint comprises a hinge formed integrally with the handles.

According to a further embodiment of the invention, in a pair of scissors having a pair of blades provided with a one-piece force applying member, such member comprises a plurality of integrally formed hinges.

According to a preferred embodiment of the present invention, in a pair of scissors having molded handles and an integrally formed hinged joint, the handles are provided with a ridge support to maintain the blades in contact during cutting operations.

Other advantages of the present invention will become apparent from the detailed description given hereinafter. It should be understood, however, that detailed descriptions and specific embodiments are given by way of illustration only since, from this detailed description, various changes and modifications within the spirit and scope of the invention will also become apparent to those skilled in the art.

BRIEF DESCRIPTION OF THE DRAWINGS

The preferred exemplary embodiment of the present invention will hereinafter be described in conjunction with the Fended drawings, wherein like numerals denote like elements and:

FIG. 1 is a side elevation view of a pair of scissors according to a second embodiment of the present invention.

DETAILED DESCRIPTION OF A PREFERRED EXEMPLARY EMBODIMENT

Figure 1:
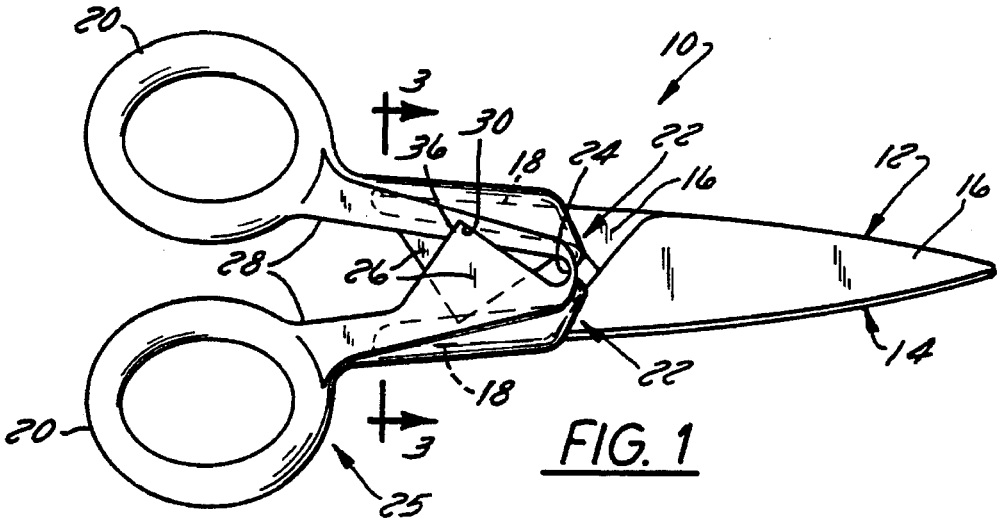
FIG. 1 is a side elevation view of a pair of scissors according to the present invention.
Figure 2:
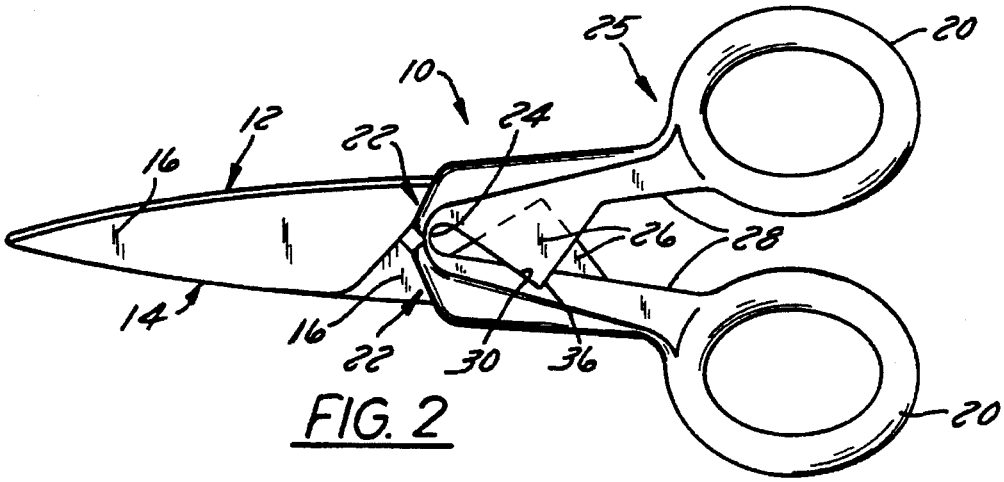
FIG. 2 is a rear side elevation view of the scissors shown in FIG. 1.
Figure 3:
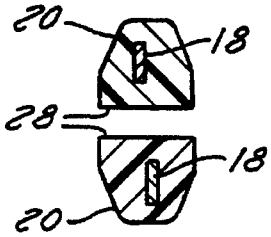
FIG. 3 is a sectional view, taken along line 3—3 shown in FIG. 1.
Figure 4:
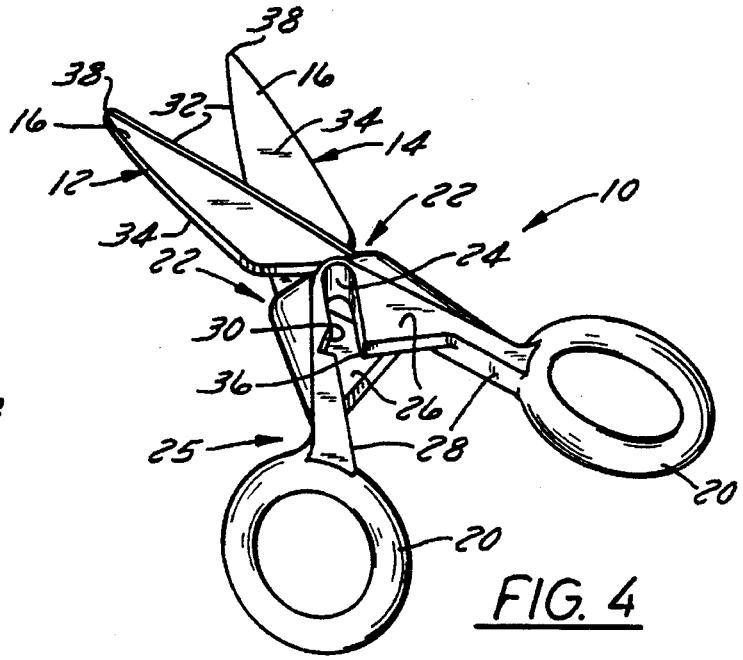
FIG. 4 is a perspective view of the scissors of FIG. 1.

The present invention relates to tools having elongated members disposed for cooperative engagement about a joint wherein a working force, which is applied to the force applying end of the tool, is transmitted through the joint to the opposed working end of the elongated members and transferred to a working piece engaging such working ends. Accordingly, the term "scissors" as used herein from time to time should also be understood to connote other types of tools such as shears, nippers, pruners, etc., while the use of the terms "plastic handle" and "plastic hinge member" further comprehend similar materials which can be utilized to form the molded handles and hinge. In this vein, those skilled in the art will further appreciate that the device described herein and its principle of operation may be adapted to tools other than scissors. Thus, while the present invention is hereinafter described with particular reference to a pair of scissors, the skilled artisan will readily appreciate its many other applications.

Referring to FIGS. 1–6, a pair of scissors in accordance with the present invention, designated generally as 10, is shown to include first and second elongated members 12 and 14. Elongated members 12 and 14 comprise a working end (a scissor blade) 16, which is made of metal, ceramic material or the like, and a tang 18. Handles 20 are molded on tangs 18 at tang receiving ends 22. For reasons which will become more apparent from the following paragraph, handles 20 are preferably formed of a material that can be easily molded such as for example polypropylene.

An articulation permitting motions of blades 16 essentially in one plane, i.e. a hinge member, generally designated as 24 is integrally molded with handles 20 thereby uniting handles 20 in a one-piece force applying end 25. The cavity of the mold forming force applying end 25 is such that mold cavities forming handles 20 communicate at tang receiving ends 22 by a narrowing space suitable to form hinge 24, which is also called by those skilled in the art a "living hinge." Integral hinge 24 should be suitably constructed to permit intended operation of tool 10. More specifically, hinge 24 should be of sufficient thickness to withstand repeated operation of handles 20 (i.e., convergence or divergence of handles 20), while only necessitating an amount of effort to operate tool 10 typically required of tools of this type. Alternatively, hinge 24 may also comprise an inward facing crease or series of perforations extending along the width of hinge 24, i.e., along an axis drawn horizontally in FIG. 6.

It should be recognized that in the case of anvil-type implements, for example elongated member 14 will be formed as one single element (i.e., combining handle 20 and working end 16 of elongated member 14 into one member). In that case, handles 20, hinge 24 and working end 16 of elongated member 14 would be united as a one-piece structure.

Referring more particularly now to FIGS. 3–6, as is well known in the scissor manufacturing art, for adequate operation of a pair of scissors the cutting edges of the scissors are preferably in contact at a single point throughout the cutting operation. This typically requires the blades of the scissors to be provided with a certain amount of inward camber. In the present invention as will be explained in greater detail below, to provide and maintain such desired single contact point between cutting edges 32 of blades 16, tools in accordance with the preferred embodiment of the present invention are provided with "ridge support" on force applying end 25 of tool 10. Such ridge support generates forces, on the handle-side of tool 10, which are transmitted through hinge 24 to establish a single contact point between blades 16. More specifically, handles 20 are provided with ridge support in the form of heel elements 26 extending inwardly of inner surfaces 28 by a predetermined distance. Handles 20 further include a recess 30 engaging the distal end of heel elements 26 when scissors 10 are in closed configuration. To provide such desired single contact point during cutting operations, heel elements 26 are suitably profiled. As more particularly shown in FIGS. 7–9, each heel element 26 includes an inner face 25 spaced from an oppositely facing outer face 27 by a distance which is slightly greater in the region of element 26 proximate inner surface 28 than at a distal end 29. Accordingly, as shown in the first exemplary embodiment, upon convergence of handles 20, the inter-engagement of profiled heel elements 26 develops forces in a direction perpendicular to the plane of scissors 10, i.e., perpendicular to the axis drawn vertically in FIG. 6. Those forces, transmitted through hinge 24, are applied laterally to working ends (blades) 16, forcing together inner surfaces 34 of blades 16 thereby creating suitable contact between cutting edges 32 during convergence of handles 20.

Figure 6:
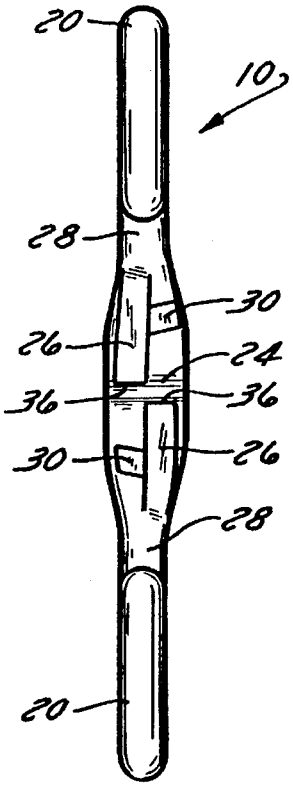
FIG. 6 is an end elevation view of the scissors shown in FIG. 5.

It should also be recognized that the inter-engagement of heel elements 26 also avoids twisting of handles 20 outside the plane of these handles, i.e., outside the axis drawn vertically in FIG. 6. Those skilled in the art will further recognize that although, as shown more particularly in FIGS. 7 and 8, the profile of heel elements 26, having an incline angle identified as $\alpha$ of preferably one degree, is progressive, heel elements having other incline grades, profiles or configurations may be used to provide the desired amount of contact between the inner surfaces of other hinged tools constructed in accordance with this invention.

As previously indicated, tools such as scissors require an adjustment of the amount of friction between the inner surfaces of the blades. Such an adjustment, which is usually done manually typically as the last step in the manufacturing process, consists of striking the pivotable joint with a suitable impact tool or adjusting the fastener of the scissors. In the present invention, during the cutting operation, engaging heel elements 26 develop forces which are transmitted through hinge 24 to maintain suitable contact between blades 16. As a result, tool 10 does not require post-manufacturing operations to adjust the amount of friction between inner surfaces 34 as with prior art scissors. It should also be recognized that scissors in accordance with the present invention eliminate the problem associated with prior art scissors which tend to lose their initial factory adjustment due to mechanical wear in the pivot.

Figure 5:
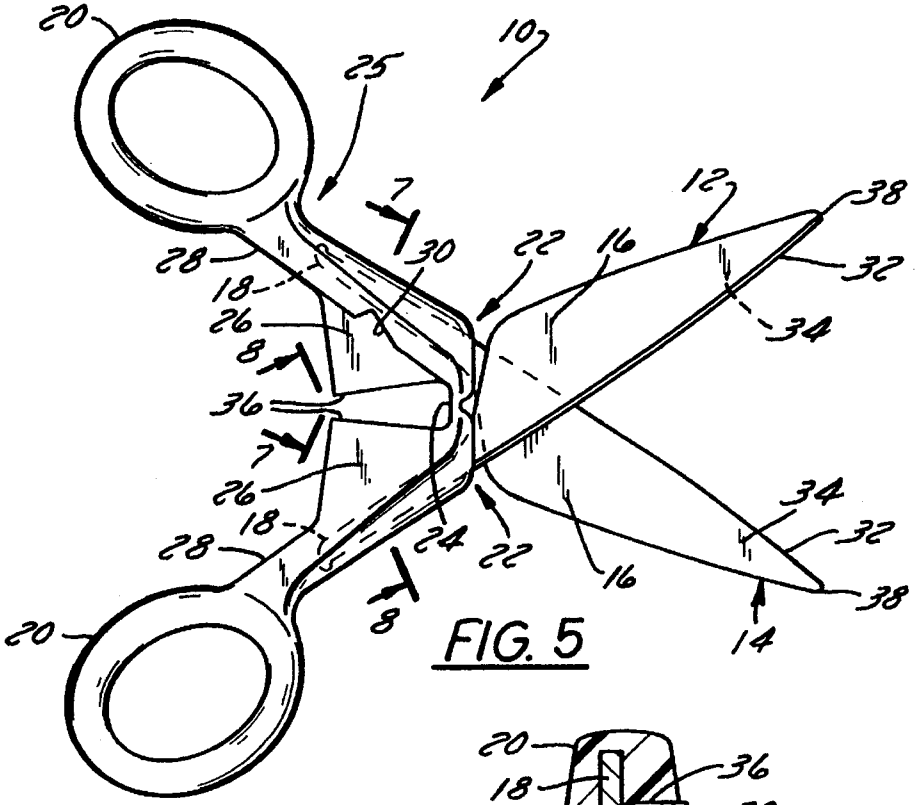
FIG. 5 is side elevation view of the scissors of FIG. 1 shown in the open configuration.

Furthermore, the manufacturing of hinged tools in accordance with the present invention also eliminates a second manual finishing operation which is typically required with scissors manufactured by conventional methods. More specifically, proper operation of scissors requires a certain amount of rotational overlap of the tips of the blades when the scissors are in a closed configuration. Referring to FIG. 5, handles 20 are provided with recesses 30, in which the abutment end 36 of heel elements 26 are seated when scissors 10 are in a closed configuration. As can be readily appreciated, this particular configuration allows adequate rotational overlap of the tips 38 of working ends 16, thereby eliminating secondary finishing operations typically required to achieve that condition.

Figure 7:
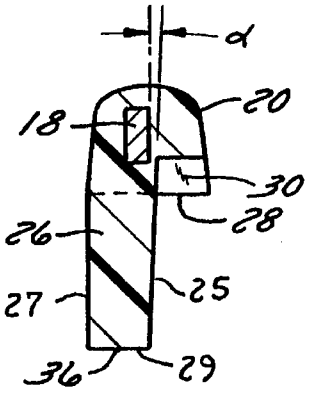
FIG. 7 is a fragmentary sectional view, taken along line 7—7 show in FIG. 5.
Figure 8:
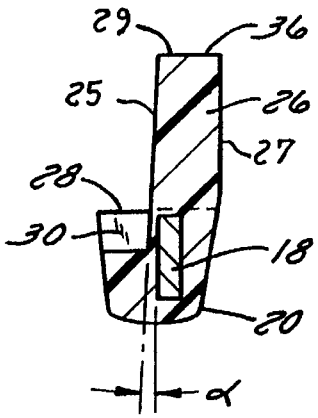
FIG. 8 is a fragmentary sectional view, taken along line 8—8 of FIG. 5.
Figure 9:
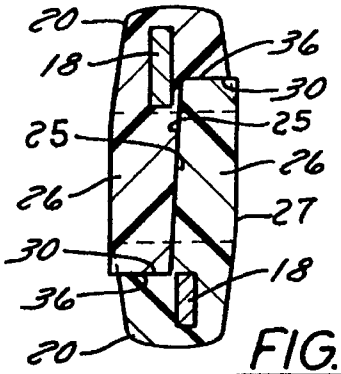
FIG. 9 is a fragmentary sectional view, taken along line 7–8 showing FIG. 5.

Another benefit derived from the inter-engagement of heel elements 26 profiled as shown in FIGS. 7 and 8 is that, when scissors 10 are in the closed configuration, the maximum amount of lateral pressure is applied to working ends 16, thereby increasing the amount of friction between inner surfaces 34. While such increased friction allows scissors 10 to remain in a closed configuration, it does not detrimentally affect normal operation.

Figure 10:
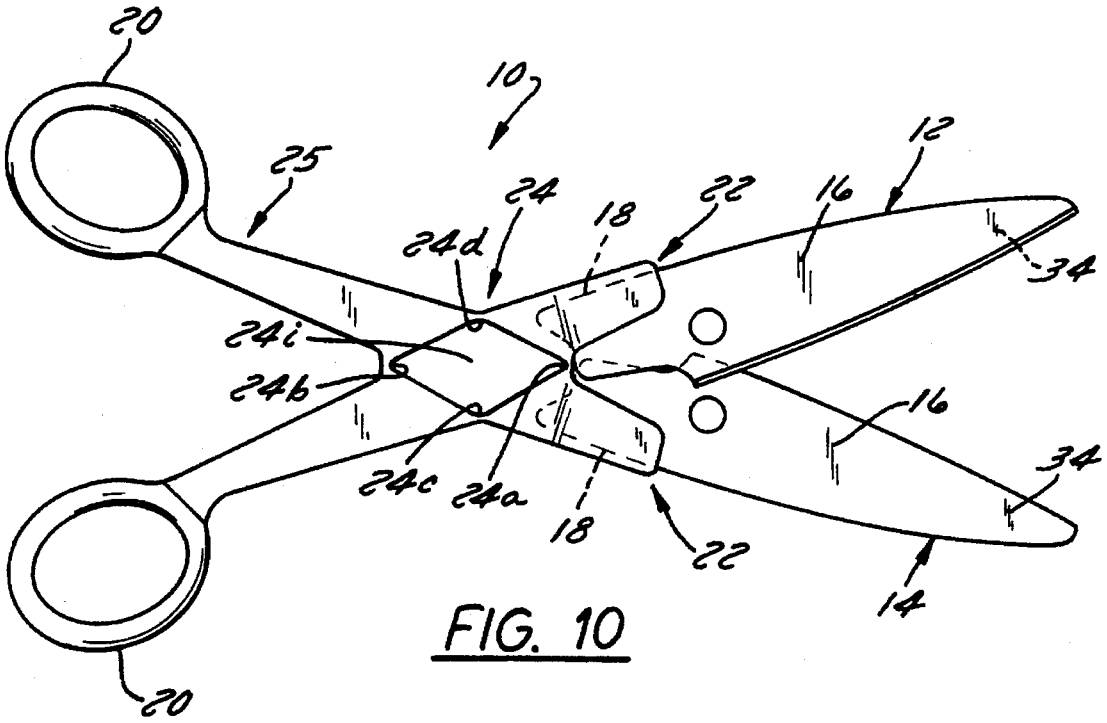

A second exemplary embodiment of the present invention is illustrated in FIG. 10. In accordance with this second embodiment, in a pair of scissors generally designated as 10, hinge 24, which comprises four cooperating hinges designated generally as 24*a*, 24*b*, 24*c*, and 24*d*, is used to transmit to blades 16 a force applied to force applying end 25. As can be more readily appreciated with reference to FIG. 10, upon divergence of handles 20 (i.e., to open scissors 10), oppositely facing cooperating hinges 24*a* and 24*b* close, i.e., the angle of such hinges facing toward inner area 24*i* of hinge 24 becomes smaller, while oppositely facing cooperating hinges 24*c* and 24*d* open up, i.., the angle of such hinges facing toward inner area 24*i* becomes larger. Conversely, in response to convergence of handles 20 (i.e., to close scissors 10), the inner angles of cooperating hinges 24*a*, 24*b* will become larger while that of cooperating hinges 24*c*, 24*d* will become smaller. Accordingly, hinge 24 transmits to blades 16 a force applied to force applying end 25, and the cooperating action of hinges 24*a*–24*d* will convert the convergence or divergence of handles 20 into respective convergence or divergence of blades 16.

It is understood that the above description is of preferred exemplary embodiments of the present invention, and that the invention is not limited to the specific forms described herein. For example, hinged tools in accordance with the present invention may not require ridge support features designed to develop forces to establish a single contact point during the operation of such tools. Alternatively, to oppose the force arising during cutting operations which tends to force inner surfaces 34 apart, the force developed by engaging heel elements 26 can be supplemented by providing blades 16 with a desirable amount of inward camber. Moreover, even though the embodiments shown in the Figures are the preferred embodiments, it is to be noted that this invention, which is based on tools having a pair of hingedly cooperating members wherein the hinge is formed integrally with the handles of such members, can be carried out in other manners. The hinge may for example be constructed in a manner other than those disclosed herein as a result of different mold configurations or manufacturing operations. However, such other constructions and features are considered to be within the scope of this invention. Accordingly, these and other substitutions, modifications, changes and omissions may be made in the design and arrangement of the elements and in the manufacturing steps disclosed herein without departing from the scope of the appended claims.

We claim:

1. A hinged tool comprising:

(a) first and second elongated members each including a tang and an opposed blade having a cutting edge;

(b) first and second handles each including a force applying end and an opposed tang receiving end, each of said tang receiving ends being molded into engagement with a respective one of said elongated members at the tang thereof;

(c) a hinge formed integrally with said handles, said hinge interconnecting said handles at said tang receiving ends; and (d) means for forcing said blades together to establish suitable contact between said cutting edges wherein said forcing means includes a pair of oppositely facing, profiled heel elements, each heel element extending inwardly from a respective one of said handles by a predetermined distance, said heel elements inter-engaging upon convergence of said handles.

2. The tool of claim 1, wherein each of said heel elements includes an inner face spaced from an oppositely facing outer face by a distance which progressively decreases from said handle to a distal end of said heel element, said inner faces inter-engaging upon convergence of said handles thereby developing a force, transmitted through said hinge to force said blades together, which varies progressively with the convergence of said handles.

3. The tool of claim 1 wherein the heel element of at least one of said handles abuts against the other of said handles upon full convergence of said handles.

4. The tool of claim 1 wherein each of said handles includes spaced apart inner and outer surfaces and wherein each of said heel elements extends from said inner surface of a respective one of said handles.

5. The tool of claim 4 wherein the heel element of at least one of said handles abuts against the inner surface of the other of said handles upon full convergence of said handles.

6. The tool of claim 4 wherein the inner surface of each of said handles further comprises a recess, and wherein each of said heel elements includes an abutment end at a distal end thereof, the abutment end of the heel element of at least one of said handles being seated in the recess of said other handle upon full convergence of said handles.

7. The tool of claim 6, wherein each of said heel elements includes an inner face spaced from an oppositely facing outer face by a distance which progressively decreases to said abutment end.

8. The tool of claim 7, wherein said profiles have an incline angle of approximately 1°.

9. The tool of claim 1 wherein said cutting implement is a pair of scissors.

10. The tool of claim 1 wherein said heel elements are substantially identical.

11. The tool of claim 1 wherein said predetermined distance is such that said heel elements inter-engage over substantially the entire convergence of said handles.

12. The tool of claim 1 wherein said heel elements are substantially triangular-shaped.

13. A hinged tool comprising:

(a) first and second elongated members each including a tang and an opposed blade having a cutting edge;

(b) first and second handles each including a force applying end and an opposed tang receiving end, each of said tang receiving ends being molded into engagement with a respective one of said elongated members at the tang thereof;

(c) a hinge formed integrally with said handles, said hinge interconnecting said handles at said tang receiving ends; and (d) means for developing a force which transmitted through said hinge forces said blades together to establish suitable contact between said cutting edges, said means for developing a force including first and second opposing profiled heel elements inter-engaging upon convergence of said handles thereby developing said force.

* * * * *